US005228579A

United States Patent [19]

Kaufman

[11] Patent Number: 5,228,579

[45] Date of Patent: Jul. 20, 1993

[54] MERCHANDISE DISPLAY PANEL

[75] Inventor: Aaron Kaufman, Rosedale, N.Y.

[73] Assignee: Bon Art International, Newark, N.J.

[21] Appl. No.: 871,668

[22] Filed: Apr. 21, 1992

[51] Int. Cl.[5] ..... A47F 5/08

[52] U.S. Cl. ..... 211/94; 211/87; 52/36

[58] Field of Search ..... 24/87, 94, 189; 52/36

[56] References Cited

U.S. PATENT DOCUMENTS 4,968,171 11/1990 Shell ..... 52/282 X 5,125,518 6/1992 Ward ..... 211/94 X

*Primary Examiner*—Blair M. Johnson

[57] ABSTRACT

A merchandise display panel having a rear wall with parallel T-shaped ribs on one or both sides forming alternating slats and grooves for receiving merchandise hooks, shelf brackets, earring cards and the like, each groove including an upper locating abutment rib extending inwardly a preselected distance from the bottom of the slat above the groove and a lower locating abutment rib extending outwardly to a second preselected distance from the top of the slat below the groove. The preferred embodiments are extruded in sections of thin-walled aluminum with angles providing high strength, and with complementary extruded coupling elements along the upper and lower edges of each section to be clamped tightly together, and with an extruded fastener-receiving channel in each section for attachment of an optional frame. Alternative embodiments are one-piece cold-rolled sheet metal panels with bends providing functionally similar slats, grooves and upper and lower abutment ribs.

25 Claims, 2 Drawing Sheets

MERCHANDISE DISPLAY PANEL

BACKGROUND OF THE INVENTION

This invention relates to merchandise display panels for receiving and supporting display hardware such as mounting brackets and hooks for holding and displaying merchandise, and relates more particularly to a display panel of the so-called "slatwall" type in which a plurality of parallel slots or grooves are formed across at least one side of the panel and shaped to receive and engage mounting elements on the display hardware. Panels of this general type also are sometimes referred to as "slotwall" panels, because of their slots.

In the past, display panels have been made in a variety of forms, one of the popular older forms being the so-called "pegboard" panel in which wire hooks and brackets with bent ends forming mounting elements are supported in rows of holes spaced apart on a flat board panel. An improved version of this kind of panel is shown in Pat. No. 4,461,443. An early alternative to the pegboard panel was the so-called "slatboard" panel, in which a plurality of parallel grooves or slots were cut in a panel, with specially shaped hardware for engaging in the slots. An improved panel of this kind is shown in Pat. No. 4,591,058, in which separate boards on a backing have shaped edges defining the mounting grooves or slots.

Another type of display panel, designed to replace the pegboard type, is the metal panel shown in Pat. No. 3,698,565. This panel is either roll-formed sheet metal or extruded metal, and has a series of L-shaped lips along at least one side forming troughs on which hardware with hook-like mounting elements may be supported. The outer sides of these lips lie generally in a common plane as spaced, parallel slats over which the hook-like mounting elements are hung. Another panel of this general type but with differently configured lips is shown in U.S. Pat. No. 4,678,151.

Another variation is shown in U.S. Pat. No. 4,531,331, which has T-shaped ribs with outer ends which lie in a common plane and define upwardly and downwardly opening channels or troughs for receiving brackets with upper hook-like mounting elements for hanging over the upper edges of the ribs and bodies for engaging the outer sides of the ribs, and with inwardly extending flanges or projections for resting on the rear wall of the panel in one of the channels.

Standard hardware has been developed for various systems of the foregoing general types that continue to be used, some being made of wood or composition material and others being metal or plastic. The wood and composition versions generally are less expensive, but usually lack the strength of metal and therefore are made in thicker and more cumbersome styles, typically having grooves that are three or four inches apart "on center". Other systems use two-inch spacing, and some use one-inch spacing, with standard hardware in each case designed for the particular slot configuration and for the spacing of the slots as well. Moreover pegboard hardware is made in at least two sizes for use in two different systems using 3/16 and ¼ inch diameter holes.

While the use of metal and plastic has distinct advantages, the shapes that have been used in the past have been relatively complex and difficult to mass produce economically. Moreover, when made thinwalled for economy and lightness in weight, some of these have lacked the strength needed to support relatively heavy loads.

SUMMARY OF THE PRESENT INVENTION

The present invention resides in an improved and highly versatile merchandise display panel of the "slatwall" or "slotwall" type that is capable of use with most, if not all, of the standard hardware that presently is in use, and, in addition, is capable of being mass-produced of either extruded or roll-formed metal in single-sided and double-sided forms that are streamlined and attractive in appearance and relatively strong for the amount and thickness of material used. To these ends, the display panel of the invention comprises a substantially flat rear or inner wall that is upright when the panel is in the usual upright display position, and a plurality of ribs of relatively thin-walled T-shaped cross-section on at least one side of the rear wall that have spaced, parallel outer ends, or "slats" forming a series of vertically spaced grooves that have special abutments positioned in the grooves to provide tight and secure holding engagement with the mounting elements of a wide variety of the standard hardware systems presently in use.

In the preferred embodiment shown herein, the special abutments are the free edges of two elongated ribs in each groove, one extending inwardly along the lower edge of each slat a preselected distance from the plane of the outer side to form an element-receiving internal slot located in the upper portion of the groove, and the other extending outwardly from the rear wall of the panel below the level of the upper edge of each slat with its outer edge a second preselected distance from the plane of the outer side. This second rib cooperates with the rear wall to form a second element-receiving slot, this one located in the lower portion of the groove. The free edge of the upper rib faces inwardly to engage and brace upper mounting elements against outward movement, while the free edge of the lower rib faces outwardly to engage and brace lower mounting elements against inward movement. Thus, both of these ribs are positioned to assist in holding such mounting elements firmly in load-carrying positions, as will be seen in more detail hereinafter.

Another feature of the present invention is the capability of the panel to be formed as a relatively thin metal extrusion or molding that has higher than expected strength. To impart extra strength to the panel, the special ribs are formed integrally with the T-shaped ribs and the rear wall at substantially right angles with them, and additional short reinforcing ribs are formed on the opposite side of the rear wall when the panel is single-faced.

To permit extruding of the panel in elongated relatively narrow sections and subsequent secure joining of two or more such sections into a larger assembly, each section is made in a practical width for extruding, such as four-inches wide, and provided with mating complementary coupling elements along its opposite longitudinal edges. These coupling elements herein are an enlarged upper edge forming a bead of circular cross-section having a diameter slightly greater than the thickness of the rear or inner wall, and two arcuate webs on the lower edge defining a downwardly opening channel of part-circular cross-section sized to receive the bead endwise into the channel with a close sliding fit, to be clasped in the channel. For tightness, the metal webs may be clamped together into a securely joined assembly, which may be painted or otherwise decorated either before or after assembly.

Such an assembly may be used without a frame or may be enclosed in a frame, either for free-standing use or hung on a wall or other support. To facilitate joinder of frame members to the ends of the panel sections, each extruded section preferably has a longitudinal part-circular fastener channel that is formed during the extruding process in addition to the joint-forming channel along its upper edge. The illustrative fastener channels have part-circular walls with a gap on one side smaller than the diameter of the channel, forming holes at the ends of the section to receive fasteners such as machine screws through side frame members. These elements also strengthen the panel.

Whether single-sided or double-sided, such a display panel may be made relatively thin-walled but will have substantial strength as a result of the various angles of the rear wall, the T-shaped ribs, the special positioning ribs and the reinforcing ribs on the rear side, as well as the coupling joints and the fastener channels. A suitable panel may be made of 6063-T5 aluminum on one-inch centers, with slats and grooves approximately one-half inch wide, wall thickness of approximately 0.062 of an inch (preferably 0.080 for the rear or inner wall), and internal ribs spaced from the plane of the outer surface preselected distances in the range of 0.184 to 0.200 of an inch, the upper rib edge preferably being at 0.187 of an inch, slightly closer than the lower rib edge which preferably is at 0.197 of an inch. The total panel thickness may be less than one-half inch for a single-sided panel and less than one inch for a double-sided panel. These dimensions may be varied, of course, without departing from the scope of the present invention.

Two alternative embodiments are one-piece panels formed of cold-rolled steel, preferably in a standard sheet metal thickness such as 0.0179 or 0.0239 of an inch, with bends in the steel providing abutment surfaces and dimensions that are similar to those of the extruded form. Functionally, these embodiments are closely similar to the extruded embodiments.

Other features and advantages of the invention will be apparent from the following detailed description, taken in conjunction with the accompanying drawings.

DETAILED DESCRIPTION OF THE PREFERRED EMBODIMENT (FIGS. 1–3)

Figure 1:
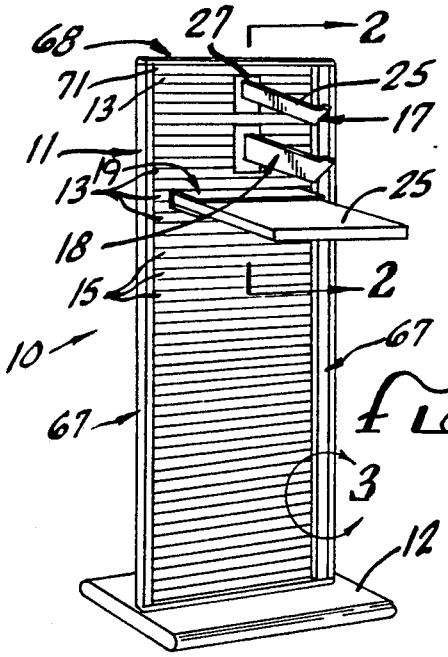
FIG. 1 is a front perspective view of a double-sided merchandise display panel formed of extruded metal in accordance with the present invention, shown in an illustrative frame that is supported in an upright display position on an illustrative base, and with representative hardware members mounted on one side of the panel.
Figure 2:
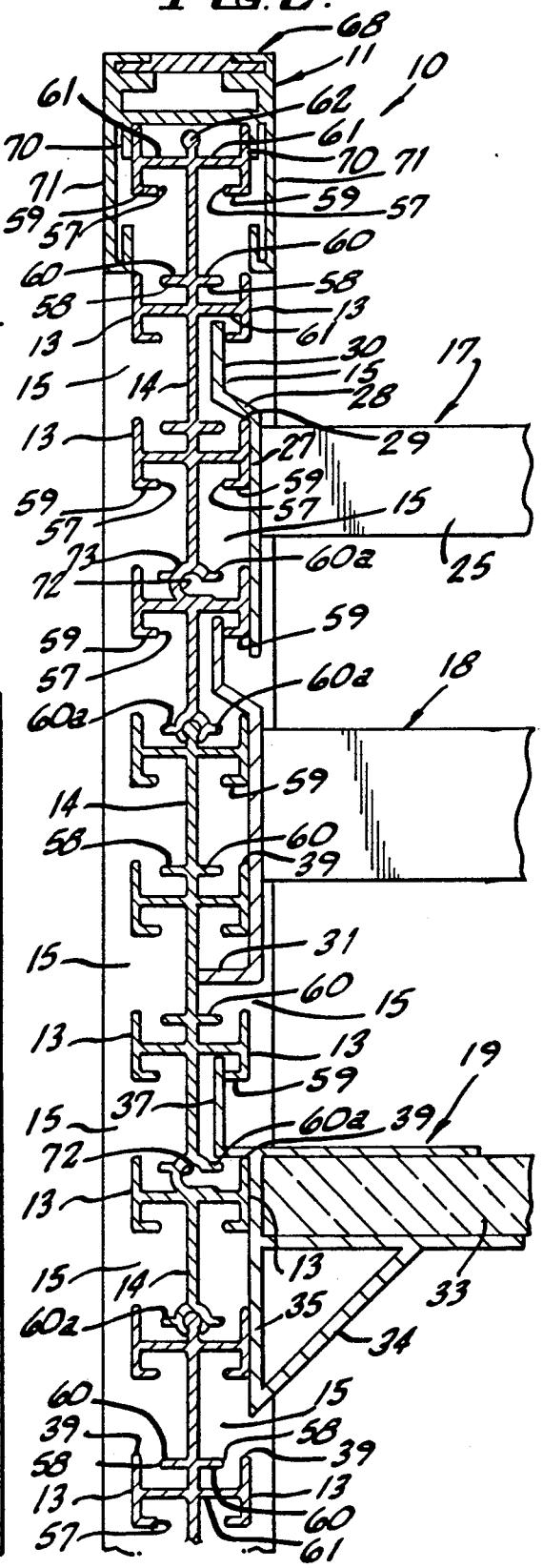
FIG. 2 is an enlarged fragmentary cross-sectional view taken substantially along line 2—2 of FIG. 1 and showing the engagement of the hardware members in the grooves.
Figure 3:
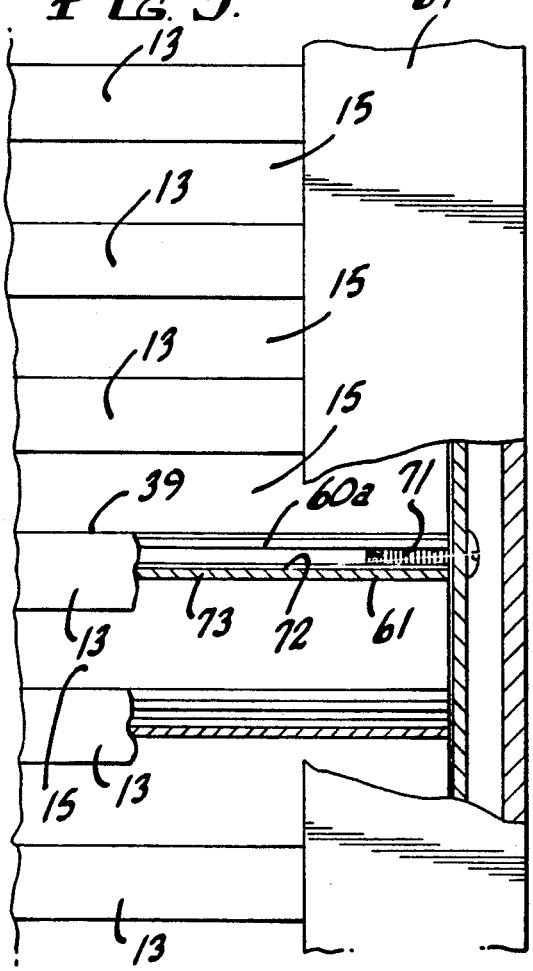
FIG. 3 is an enlarged fragmentary side elevational view taken within the arc 3 of FIG. 1 and partially broken away and shown in cross-section.

As shown in FIGS. 1–3 for purposes of illustration the invention is embodied in an extruded metal merchandise display panel, indicated generally by the reference number 10 in FIGS. 1, 2 and 3, mounted in an illustrative frame 11 on a base 12 and having a plurality of spaced, horizontal slats 13 supported on a rear or inner wall 14 and defining a plurality of grooves or slots 15 in the front or outer side of the panel for supporting a number of representative pieces of display hardware 17, 18, and 19. These pieces of hardware comprise two so-called "slatwall brackets" 17 and 18 of slightly different configurations and a shelf bracket 19 of the slatwall type. Other pieces of hardware 20, 21, 22 and 23 and a jewelry card 24 shown in FIGS. 4 and 5 also may be used on the panel 10.

It is to be understood that the various pieces of hardware, including the jewelry card 24, are conventional and standard parts that are well known in the merchandising field, having been designed for use with a variety of different display panels. The upper slatwall bracket 17 has an outwardly projecting hanger arm 25 for holding an article of merchandise (not shown) and a mounting plate that is engageable with the panel. For this purpose, the plate has a flat body 27 which rests against the outer side of the display panel 10, herein against the outer sides of two slats 13, and an upper bend 28 that extends inwardly into the slot above the body, forming a shoulder that is engageable with the upper edge 29 of the slat and an upper edge portion 30 that projects upwardly with the slot to hold the slatwall bracket in place. The second slatwall bracket 18 is similar, but has an inwardly bent lower end portion 31 that projects into a lower slot 15 and abuts against the rear wall 14 to stabilize the bracket. Both of these brackets presently are used in popular slatwall systems.

Figure 4:
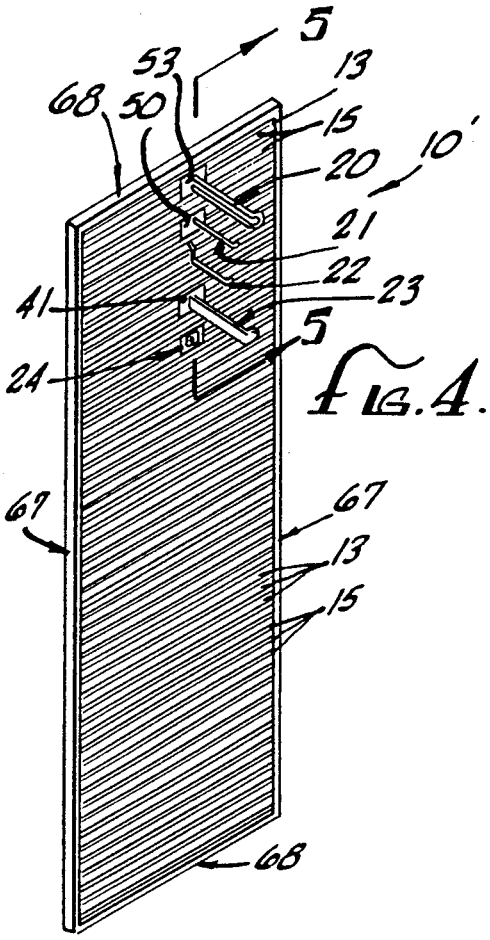
FIG. 4 is a front perspective view similar to FIG. 1, showing a single-sided display panel of extruded metal without a base, with other representative hardware members mounted on the panel.
Figure 5:
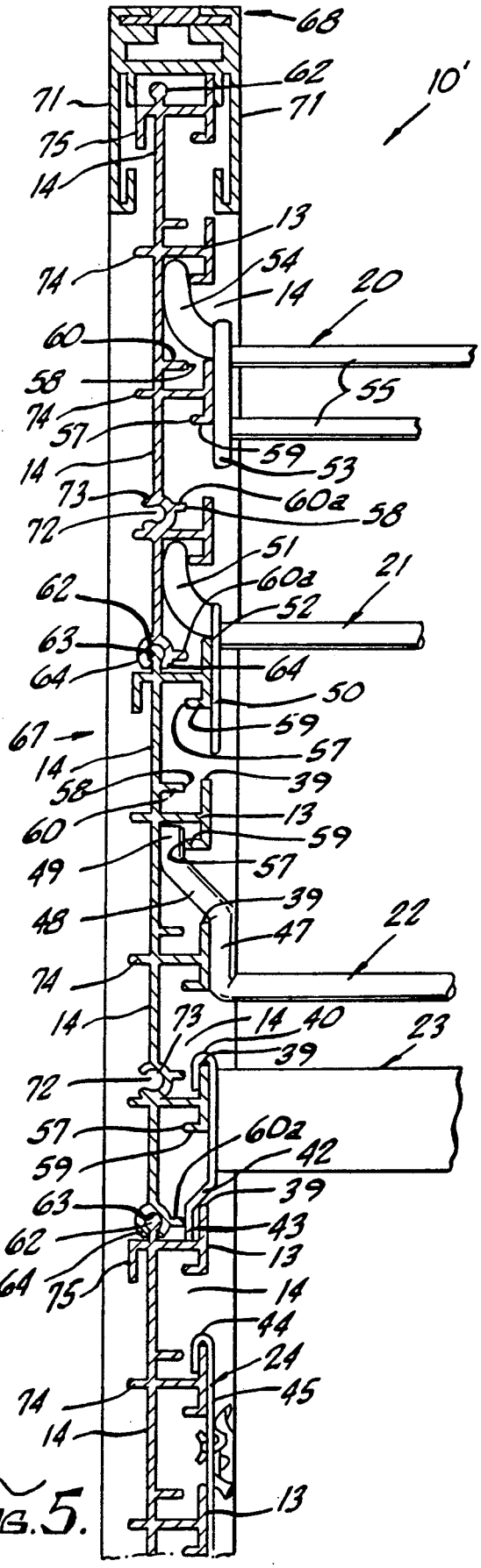
FIG. 5 is a fragmentary enlarged cross-sectional view similar to FIG. 2 taken along line 5—5 of FIG. 4, showing the single-sided panel and the manner of engagement of the additional hardware members in the grooves.

Two other variations in slatwall hardware are represented by the shelf bracket 19 (FIGS. 1 and 2) and a mini bracket 23 shown in FIGS. 4 and 5. The shelf bracket is an extruded metal part with two parallel flanges 32 for receiving and holding a glass or wood shelf 33, and braced by a web 34, and with a rear wall 35 forming a body engageable with two or more slats 13. A holding rib 37 along the upper edge is engaged in the upper slot, and a shoulder 38 beneath the holding rib is engageable with the upper edge 39 of the slat 13 immediately below the slot. The mini bracket 23 differs in that it has an upper edge portion 40 which is bent over to form a hook that is sized to fit closely over the upper edge 39 of a slat 13, a body 41 that engages the same slat, a lower end portion that has an inward bend 42 extending into the slot below the slat, and a straight lower edge portion 43 trapped inside the next lower slat. The earring card 24 (FIG. 5) is similar in having a bent upper edge portion 44 for hanging over the upper edge of a slat. The body 45 of the earring card, which typically is light and somewhat flexible material, simply hangs down across one or more of the slats 13.

The illustrative pegboard items shown in FIGS. 4 and 5 represent three different kinds of pegboard hardware. First, the lower hook 22 is of the well-known kind that is made of wire and is bent to form a body 47 at the inner end of the hook, for abutting against the outer side of one of the slats 13, and an inwardly bent portion 48 extending into the slot 15 and an upwardly bent tip 49 behind the slat above. When used in a standard pegboard panel (not shown), the bend 48 goes through a hole and the tip 49 engages the rear side of the board. Often, such a hook has a lower peg (not shown) for engagement with a lower pegboard hole.

Shown above the standard wire hook 22 is the pegboard hook 21 which has a stamped sheet metal body 50 having two integral "ears" 51 on opposite sides constituting mounting elements for engagement with the panel, the hook itself being welded at 52 to the body. Above this hook is the hook 20, which is a molded plastic hook that has generally the same configuration, including a plastic body 53 and two "ears" 54 constituting mounting elements, but has a double plastic arm 55 that is molded with the body and the ears. These hardware items are merely illustrative. It is to be understood that numerous such items may be positioned around the panel as needed to hold various kinds of merchandise thereon.

In accordance with the present invention, the merchandising display panel 10 has a substantially flat rear or inner wall 14 that is upright when the panel is in the upright display position and a plurality of elongated ribs of T-shaped transverse cross-section on at least one side of the rear wall forming the slats 13 and defining the grooves 15, with special abutments 57 and 58 (see FIG. 2) positioned in the grooves to provide secure holding engagement with the mounting elements of various standard items of display hardware. In the preferred embodiments shown herein, two sets of such abutments are provided, one upper set in each groove 15 facing inwardly and spaced a preselected distance from the outer side of the slat 13 above the groove, and one lower set facing outwardly and spaced a second preselected distance from the outer side of the slat 13 below the groove. These abutments herein are the inner and outer edges, respectively, of two ribs 59 and 60 in the grooves, spaced from the slats to form narrow gaps for receiving the mounting elements of the various hardware pieces and providing firm locating engagement in the grooves.

More specifically, as shown most clearly in FIG. 2, the extruded panel 10 of this embodiment is of the double-sided type in which similar T-shaped ribs are provided on both sides of the rear or inner wall 14 so that both faces of the panel can be used to display merchandise. The configuration on each side is essentially a mirror image of the other side, so the description of one side describes the other as well. Thus, the same reference numbers can be used on each side. The T-shaped ribs on both sides have outer ends that form the slats 13 and have webs 61 that extend between the slats and the inner wall 14 to support the slats in spaced relation on the panel 10. The webs are integrally joined at opposite ends to the inner wall and to the slats, preferably midway between the upper and lower edges of the slats, and are horizontal when the inner wall is in a vertical display position.

As can be seen in FIG. 2, the upper abutment ribs 59 extend inwardly from the lower edges of the slats 13, level with those edges and at right-angles with the outer surfaces of the slats, which lie in the plane of the outer face of the panel, making the lower portion of each slat generally L-shaped. The lower abutment ribs 60 extend outwardly from the inner wall 14 immediately below the level of the upper edges 39 of the slats, at right angles with the plane of the inner wall, which parallels the plane of the slats. In the double-sided panel, the lower abutment ribs 60 on opposite sides of the panel are aligned in pairs, as are the webs 61. These elements preferably have a constant wall thickness, although the inner wall 14 may be made somewhat thicker for increased strength.

Although the invention may be embodied in panels with other dimensions, it has been found to be particularly advantageous to design the slats on one-inch "centers" (that is, with one slat and one groove per inch) so that small hardware pieces designed for this size and spacing may be used, as well as hardware designed for panels with grooves on two-inch, three-inch or four-inch centers. All are usable with the invention when constructed on one-inch centers. In addition, the preferred embodiment is designed to use wall thicknesses as thin as practically possible—approximately 0.06 of an inch in 6063 T-5 aluminum (nominally 0.062), preferably with an inner wall that is either 0.062 or 0.080 of an inch thick.

With this basic design, it has been found that the optimum spacing of both abutment edges is approximately 0.19 of an inch with the preferred spacing of the upper ribs 59 slightly below 0.19 and the preferred spacing of the lower ribs 60 slightly above 0.19. Preferably the edges 57 of the upper abutment ribs 59 are spaced from the outer sides of the slats a distance in the range of 0.184 to 0.190 of an inch, and specifically about 0.187 of an inch, while the edges 58 of the lower abutment ribs 60 from the outer sides are spaced a distance in the range of 0.194 to 0.200 of an inch, and specifically about 0.197 of an inch. The preferred spacing of the outer sides from the inner wall 14 is less than one-half of an inch, so that a double-sided panel is less than one inch thick.

A practical limitation in extruding is the size of the die that can be produced at reasonable cost. To keep this size within reasonable limits, the panel 10 preferably is made in sections that can be joined together to make a larger panel. As shown herein, each section in the preferred embodiment comprises four slats 13 and has mating complementary coupling elements on its opposite ends, in the form of an enlarged bead 62 on one end of the inner wall 14 and a channel 63 on the other end. The channel is defined by two arcuate webs 65 and is of part-circular cross-section so as to receive the bead 62 endwise with a close sliding fit. To secure two or more panel sections together, the arcuate webs 64 are clamped together into a securely joined panel assembly.

A panel of this type may be used with or without a frame, and may be hung on a wall or other support, or held in a display position on a base. The illustrative frame 11 shown in FIGS. 1–3 is made up of side and end extruded frame members 67 and 68 secured to the top and sides of the panel, and the base 12 for holding the assembly in the vertical display position shown in FIG. 1 is attached to the lower end. The illustrative top end member 68 (FIGS. 1 and 2) is a cap-like extruding with two depending flanges 70 that straddle the top two slats 13 of the panel 10, and two sidewalls 71 that close the top groove 15 on each side. The side frame members 67 similarly straddle the sides of the panel, as shown in FIG. 3, and are suitably fastened in place, for example, by screws 71 as illustrated in FIG. 3.

To facilitate joinder of the frame members to the panel 10, each section of the panel herein has longitudinal fastener channel 72 of part-circular cross-section in addition to the joint channel 62 along its lower edge. As shown in FIGS. 2 and 3, these fastener channels are defined by part-circular walls 73 that are integrally formed with the inner walls, each having a gap along one side (for extrusion purposes) and opposite open ends at the ends of the panel section. The screws 71 are tightly received in the open ends.

As can be seen in FIG. 2, the inner ribs 60*a* in the two grooves 15 that contain the screw-receiving channel 72 and the joint channel 62 are formed on the arcuate walls, whereas the inner ribs 60 in the remaining grooves are formed directly on straight portions of the inner wall 14. The spacing of the outer edges 59 of these walls from the outside planes of the panel, however, is the same.

Description of the Second Embodiment (FIGS. 4 and 5)

Shown in FIGS. 4 and 5 is an illustrative single-sided panel 10' that is framed in side and end members 67 and 68 as in the first embodiment, and having T-shaped ribs on only one side of the rear or inner wall 14, the right-hand side as viewed in FIG. 5. Because the components of this panel on one side are identical to corresponding parts of the first panel 10, the same reference numbers are used to identify these parts.

The primary difference, other than omission of the T-shaped ribs on the left-hand or rear side of the panel 10', is the provision of reinforcing ribs 74 that are aligned with the webs 61 on the opposite side of the inner wall 14, and the addition of one downturned flange 75 at the upper end of each panel section to facilitate hanging of the single-sided panel in a display position. Both the ribs 74 and the flange 75 add strength to the panel. In other respects, the second embodiment is identical to the first embodiment.

Figure 6:
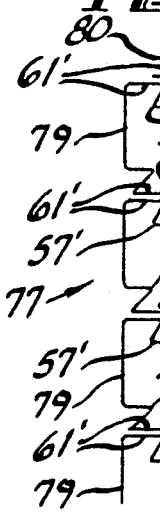
FIGS. 6 and 7 are schematic end views of alternative embodiments of the invention that are roll-formed or cold-rolled sheet metal panels with similar hardware-engaging capabilities.
Figure 7:
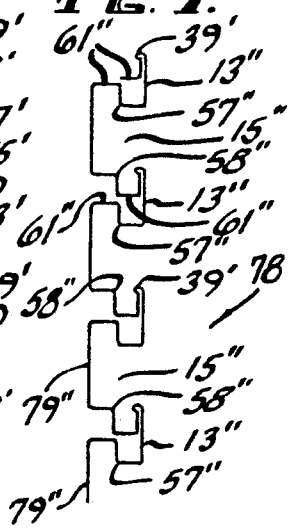

Third and Fourth Embodiments (FIGS. 6 and 7)

Shown in FIGS. 6 and 7 are two alternative embodiments that are made by bending steel sheet metal into a continuous and repeating pattern producing functionally similar display panels 77 and 78. In FIG. 6, in which some corresponding parts are indicated with primed reference numbers, a sheet is bent to form a series of generally T-shaped, double-walled ribs that project outwardly from one side of a rear wall that is formed by several flat lengths 79 of sheet material between the ribs. Between each pair of ribs is a groove 15' that opens into the panel from that side and has upper and lower portions, between adjacent ribs, for receiving the mounting elements of display hardware (not shown) to be mounted on the panel.

Each rib has two side-by-side webs 61' that extend out from the rear wall, with an upright wall 13' that forms the outer side of the "T" in the plane of the outer face of the panel. An upright wall 80 forms the inner side of the channel above the rib and is joined to the outer wall by a bend 39' constituting the upper edge of the slat. To form an upper positioning abutment corresponding to the edge 57 of the upper rib 59 in the first embodiment, a V-shaped bend is formed in the sheet between the upright wall 13' and the lower web wall 61', projecting inwardly from the lower edge with a corner 57' of the bend constituting the abutment. This corner is spaced the preselected first distance from the outer side of the slat 13'. The illustrative V-shaped bend is at an acute angle of approximately sixty degrees.

Similarly, to form a lower positioning abutment corresponding to the edge 58 of the lower rib 60, another V-shaped bend is formed in the wall section 77 below the upper edge 81 of the outer wall 13', with an outwardly extending upper wall and a downwardly and rearwardly inclined return wall, joined by a bend 58' constituting the lower positioning abutment in each groove 15'. This bend is shown as having an angle of approximately forty-five degrees.

It will be understood that the entire sheet metal panel 77 shown in FIG. 6 will be one integral piece, preferably shaped by cold-rolling, and that the dimensioning of the outer slats 13' and the grooves 15' between the slats, and the positioning of the abutment corners 57' and 58', will be done in the same manner as in the first and second embodiments. Thus, this sheet metal embodiment will perform in substantially the same manner as the extruded form. As previously stated, suitable materials will be steel sheet material in thicknesses of 0.0179 of an inch (20 gauge) or 0.0239 of an inch (24 gauge).

The other cold-rolled sheet metal panel 78 shown in FIG. 7 is substantially the same as that shown in FIG. 6 except for the configuration of the bends forming the upper and lower abutments. In this view, some corresponding parts are indicated with double-primed reference numbers. In this panel, the two abutment corners, above and below the web, numbered 57'' and 58'', respectively, are corners of right-angle bends, and the upper and lower web walls 61'' extend approximately one-half the distance between these bends and the opposite ends of the web, the lower web wall extending from the inner wall 79'' approximately one-half the way to the slat 13'' and the upper web wall extending approximately one-half the way back. In all other significant respects, this embodiment may be the same as the embodiment in FIG. 6.

Conclusion

With each of the display panels of the present invention, the various items of shelf hardware shown in the drawings may be engaged in the grooves or slots that are defined between the outer "slat" ends of adjacent ribs on the panel, whether those ribs are the preferred extruded form, the alternative cold-rolled form, or an equivalent construction. The two abutment ribs in the upper and lower portion of each groove are positioned for firm locating engagement with the various mounting elements that are in use in the several standard systems that exist in the market place. The upper abutment ribs are located to engage the upper elements of slatwall brackets as shown in FIG. 2, or to engage pegboard hooks or "ears", as shown in FIG. 5, and the lower abutment ribs are positioned to engage depending mounting elements such as the lower lip of the mini slatwall bracket shown in FIG. 5. In addition, the upper edge portion of each slat is sized to fit into hook-like mounting elements such as the bent end of the mini slat wall bracket or the similar bend on the earring card. Finally, it is to be noted that the panels of the invention are adapted to accept hardware from one-inch, two-inch, three-inch and larger systems.

From the foregoing, it will be evident that the present invention provides a highly versatile merchandise display panel that may be economically mass-produced of thin-walled but high strength extruded or cold-rolled metal, and is highly effective for its intended purpose, and that is of attractive streamlined appearance that makes it highly desirable for display use. It also will be evident that, while several embodiments have been illustrated and described in detail, various modifications and changes may be made by those skilled in the art without departing from the spirit and scope of the invention.

I claim as my invention:

1. A merchandise display panel defining a plurality of parallel grooves in at least one side of the panel for receiving and holding various types of display hardware having mounting members with different upwardly and downwardly projecting mounting elements, comprising:

a rear wall adapted to be positioned in an upright display position;

a plurality of elongated, parallel slats extending across one side of said rear wall in vertically spaced, generally parallel relation when the rear wall is in the display position, said slats having substantially flat outer sides for engaging mounting members on display hardware and upper and lower edges forming, respectively, the lower and upper boundaries of a plurality of grooves in said panel, and said slats being spaced outwardly from said rear wall to receive mounting elements between the slats and the rear wall;

a supporting web for each of said slats extending between said rear wall and the slat and joined to the latter between the upper and lower edges thereof, thereby to form upwardly and downwardly opening channels above and below said webs;

a first abutment rib on each of said slats along the lower edge thereof extending back toward said rear wall and terminating in a free inner edge spaced below the web and spaced a first preselected distance inwardly from the outer side of said slat;

and a second abutment rib on said rear wall below the level of the upper edge of each slat and above the corresponding web of that slat and projecting outwardly toward the slat, each such second rib having a free outer edge spaced a second preselected distance inwardly from the outer side of said slat;

said upper edges of said slats being substantially straight continuations of the outer sides and of relatively narrow thickness for receiving hook-like mounting elements, and said first ribs forming positioning abutments in the upper portions of the grooves for engaging upwardly projecting mounting elements, and said second ribs forming positioning abutments in the lower portions of the grooves for engaging downwardly projecting mounting elements, whereby said display panel accommodates numerous different types of display hardware.

2. A merchandise display panel as defined in claim I wherein said slats and said grooves are arranged on one-inch centers and the slats and the grooves between the slats are substantially equal in width.

3. A merchandise display panel as defined in claim 2 wherein the panel is a one-piece integral metal part.

4. A merchandise display panel as defined in claim 2 wherein said first and second preselected distances are approximately 0.19 of an inch.

5. A merchandise display panel as defined in claim 4 wherein said first preselected distance is about 0.087 and second preselected distance is about 0.197 of an inch.

6. A merchandise display panel as defined in claim 2 wherein said thickness of said slats is approximately 0.06 of an inch.

7. A merchandise display panel as defined in claim 2 wherein said panel is a double-sided display panel having a plurality of slats on both sides of said rear wall including supporting webs and first and second abutment ribs having the same configuration but in mirror image, whereby both sides are usable to receive and hold display hardware.

8. A merchandise display panel as defined in claim 2 wherein said display panel comprises a plurality of elongated, narrow panel sections each comprising a plurality of slats and grooves, said rear wall having opposite edges, and further including first and second complementarily shaped coupling elements on said opposite ends of each section for receiving and mating with the coupling elements on adjacent sections.

9. A merchandise display panel as defined in claim 8 wherein said first coupling elements are enlargements of generally circular cross-sectional shape on one end of each section and said second coupling elements are arcuate walls on the opposite edges of each section defining open ended channels of part-circular cross-sectional shape encompassing more than a half circle, thereby to receive the first coupling elements endwise into the second coupling elements.

10. A merchandise display panel as defined in claim 9 wherein said arcuate walls are bendable into tight gripping engagement with said first coupling elements to join said sections rigidly together.

11. A merchandise display panel as defined in claim 1 wherein said panel is a one-piece extruded metal piece.

12. A merchandise display panel as defined in claim 11 wherein said slats and webs are of T-shaped cross-section, said first abutment ribs are formed integrally with the slats at one edge thereof as right-angle bends, and said second abutment ribs are joined integrally to said rear wall and extend outwardly therefrom at right angles thereto.

13. A merchandise display panel as defined in claim 1 wherein said panel is a one-piece sheet of metal having bends forming the components of the panel, including said first and second abutment ribs.

14. A merchandise display panel as defined in claim 13 wherein said webs are double-walled, extending to and from said slats, and the slats also are double-walled, said first abutment rib being a corner of a V-shaped bend extending inwardly from the lower edge of the slat and then upwardly to the web, and said second abutment rib being a second V-shaped bend extending outwardly from the rear wall above the web and then back downwardly toward the inner end of the web.

15. A merchandise display panel as defined in claim 14 wherein said V-shaped bends are acute angles.

16. A merchandise display panel as defined in claim 15 wherein said V-shaped bends are substantially right angles, said web having an upper wall extending outwardly from said second V-shaped bend to the slat and a lower wall extending inwardly from said first V-shaped bend to said rear wall.

17. A merchandise display panel defining a plurality of parallel grooves in at least one side of the panel for receiving and holding various types of display hardware and hooks having mounting members with different upwardly and downwardly projecting mounting elements, comprising:

a substantially flat and generally rectangular, rear wall adapted to be positioned in an upright display position;

a plurality of elongated slats extending across one side of said rear wall in vertically spaced, generally parallel relation when the wall is in the display position, each of said slats being T-shaped in cross-sectional shape with the base of the "T" integrally joined to the wall and the cross-bar of the "T" spaced outwardly from the wall and parallel thereto, and having upper and lower edges forming, respectively, the lower and upper boundaries of a plurality of grooves in said display panel;

a first abutment rib formed integrally with each slat along the lower edge of the cross-bar of the "T" extending toward the wall and terminating in a free inner edge spaced inwardly from the cross-bar to form a first internal gap along the lower edge of the cross-bar;

and a second rib for each slat formed integrally with the rear wall and extending outwardly therefrom below the level of the upper edge and above a corresponding base of the T of that slat, said second ribs having a free outer edge spaced inwardly from the cross-bar to form a second gap along the upper edge of the cross-bar;

said gaps being of preselected sizes for receiving mounting elements of display hardward of different standard configurations and sizes.

18. A merchandise display panel as defined in claim 17 wherein said slats and ribs are of extruded metal and are substantially uniform in thickness, said rear wall being extruded integrally with the slats and ribs whereby said panel is formed as one piece.

19. A merchandise display panel as defined in claim 17 wherein said rear wall has oppositely projecting ribs on the other side thereof in alignment with the ribs on said one side, the parts on said other side being substantial mirror-images of the parts on said one side.

20. A merchandise display panel as defined in claim 17 wherein slats are formed on one-inch centers and said first abutment ribs are spaced from the outer sides of said slats a distance in the range of 0.187 to 0.190 and said second abutment ribs are spaced from said outer sides a distance in the range of 0.194 to 0.200 of an inch.

21. A merchandise display panel as defined in claim 20 wherein said T-shaped ribs and said abutment ribs have a thickness of approximately 0.06 of an inch.

22. A merchandise display panel as defined in claim 17 wherein said panel is a one-piece sheet of metal with integral bends forming said ribs on said rear wall, said first and second abutment ribs being V-shaped bends formed, respectively, on the inner sides of the lower edges of said slats and said rear wall below the upper edges of said slats.

23. A merchandise display panel defining a plurality of parallel grooves in at least one side for receiving and holding display hardware having mounting elements engageable in the grooves, comprising:

a rear wall adapted to be positioned in an upright position;

a plurality of elongated, substantially parallel slats mounted on and extending across one side of said rear wall in spaced relation with the rear wall and with each other to define grooves between said slats, each slat having a substantially flat outer side with upper and lower edges forming boundaries of grooves above and below the slat;

and an abutment rib extending inwardly from the lower edge of each slat and spaced a preselected distance inwardly from the outer side of the slat, thereby to form a restricted gap between the slat and the rear wall for engagement with mounting elements that extend upwardly into the grooves;

and a second abutment rib below the upper edge of each slat in each groove extending outwardly toward the upper edge of each slat and spaced a second preselected distance from the outer side of the slat to form a second restricted gap between the slat and the rear wall for engagement with mounting elements that extend downwardly into the grooves;

the upper edges of the slats being relatively narrow and substantially straight and aligned with the flat outer sides of the slats for engagement with mounting elements that are hook-like in shape.

24. A merchandise display panel as defined in claim 23 wherein said panel is a one-piece metal extrusion, said slats and grooves have one inch centers, and the first-mentioned preselected distances are approximately 0.19 of an inch.

25. A merchandise display panel as defined in claim 24 wherein said panel has abutment ribs on both sides of said rear wall forming a double-sided panel, the components on the other side of the panel being mirror images of those on said one side.

* * * * *

UNITED STATES PATENT AND TRADEMARK OFFICE

CERTIFICATE OF CORRECTION

PATENT NO. : 5,228,579

DATED : July 20, 1993

INVENTOR(S) : Aaron Kaufman

It is certified that error appears in the above-identified patent and that said Letters Patent is hereby corrected as shown below:

Column 9, line 67, delete "0.087" and insert therefor --0.187--;

Column 11, line 29, delete "hardward" and insert therefor --hardware--

Signed and Sealed this

Twenty-seventh Day of September, 1994

*Attest:*

*Attesting Officer*

Bruce Lehman

BRUCE LEHMAN

*Commissioner of Patents and Trademarks*